US007644538B2

(12) United States Patent
Balbo Di Vinadio

(10) Patent No.: US 7,644,538 B2
(45) Date of Patent: Jan. 12, 2010

(54) TURN/TILT CLOSURE

(75) Inventor: Aimone Balbo Di Vinadio, Chiusa San Michele (IT)

(73) Assignee: SAVIO S.p.A., Turin (IT)

( * ) Notice: Subject to any disclaimer, the term of this patent is extended or adjusted under 35 U.S.C. 154(b) by 131 days.

(21) Appl. No.: 11/761,298

(22) Filed: Jun. 11, 2007

(65) Prior Publication Data

US 2008/0016774 A1 Jan. 24, 2008

(30) Foreign Application Priority Data

Jun. 15, 2006 (IT) ..... TO2006A0435

(51) Int. Cl.
*E05D 15/52* (2006.01)

(52) U.S. Cl. ..... 49/192; 49/193

(58) Field of Classification Search ..... 49/193, 49/192, 382

See application file for complete search history.

(56) References Cited

U.S. PATENT DOCUMENTS 3,994,093 A * 11/1976 Mayer et al. ..... 49/192
4,602,457 A * 7/1986 Kreusel ..... 49/192
7,017,301 B2 * 3/2006 Balbo Di Vinadio ..... 49/192

FOREIGN PATENT DOCUMENTS

| | | |
|---|---|---|
| DE | 3225049 | 1/1984 |
| FR | 2722527 | 1/1996 |

* cited by examiner

*Primary Examiner*—Gregory J. Strimbu
(74) *Attorney, Agent, or Firm*—Patterson & Sheridan, L.L.P.

(57) ABSTRACT

A closure includes a frame that is selectively pivotable about a vertical axis and a horizontal axis. A drive assembly is disposed in a groove of the frame to selectively determine which axis the frame pivots about as the frame pivots between an open position and a closed position. The drive assembly includes a plurality of actuating members and a plurality of transmission rods that operatively connect adjacent actuating members to each other. Each of the actuating members and each of the transmission rods has a single tenon which is disposed in only one side of the groove.

4 Claims, 6 Drawing Sheets

TURN/TILT CLOSURE

CROSS-REFERENCE TO RELATED APPLICATIONS

This application claims benefit of Italian patent application number TO2006A000435, filed Jun. 15, 2006, which is herein incorporated by reference.

BACKGROUND OF THE INVENTION

1. Field of the Invention

The present invention relates to door and window frames.

2. Description of the Related Art

The invention was developed for the application to door or window frames constituted by extruded section bars made of aluminium or similar metallic alloys, constituted by a quadrangular frame formed by four section bars defining a pair of uprights and a pair of cross members. The section bars forming the frames are constituted by bars with complex section, produced by extrusion, drawing or profiling. Each of said section bars is provided on an outer side of the frame with a longitudinal groove to be used for mounting the articulation hinges and the drive assembly of the door or window frame. In the remainder of the description and in the claims, "drive assembly" means the set of devices and components that allow to transmit the opening/closing motion from the handle to the various closure elements.

Door and window frames are classified as door and window frames with wing opening, with swivel opening and with wing and swivel opening. Wing opening is defined as an opening movement that takes place by rotation around a vertical axis. Swivel opening means an opening movement that takes place by rotation around a horizontal axis. Door and window frames with wing and swivel opening can be opened selectively by means of rotation around a vertical axis or by means of rotation around a horizontal axis.

In the case of door window frames within wing opening only or with swivel opening only, the drive assembly enables to select the closed or open position of the door or window frame. In the case of door or window frames with wing and swivel opening, the drive assembly enables selectively to activate closed positions, wing opening positions or swivel opening positions, under the command of a cremone bolt device.

The standard conformation of the metal section bars for doors or windows comprises on the outer side of the frame a longitudinal groove with undercut profile formed by a base, two parallel lateral walls and two edges oriented against each other and defining an undercut engagement area at each of the lateral walls of the longitudinal groove. Mounting the components of the drive assembly in the longitudinal slots of the section bars of the frame is an operation that has a considerable impact on the time required to assemble the door or window frames. In the most traditional solutions, the members comprising the drive assembly are provided with two longitudinal tenons that engage the two undercut engagement areas of the respective longitudinal grooves. This solution is not very attractive to the manufacturers of window and door frames because it entails the need to obtain notches at the end of each groove to allow the insertion of the actuating members in the longitudinal direction.

To overcome this drawback, the document FR-A-2722527 proposed a solution in which each actuating member is provided with a single tenon that engages only one undercut area of the longitudinal groove. According to the solution described in FR-A-2722527, the actuating members are arranged contiguous in alternated fashion, so that the first actuating member has its tenon engaging a first undercut engagement area of the groove and the actuating member adjacent to it has its own tenon engaging a second undercut engagement area opposite the first one. Arranging the actuating members in alternating fashion aims to solve the problem of the stability of the engagement between the actuating members and the groove of the frame. When two or more adjacent actuating members are fastened to each other, the set constituted by the series of mutually fastened actuating members comprises at least one tenon that engages the first undercut engagement area and at least one tenon that engages the second undercut engagement area of the groove.

The drawback of this solution is that the alternated mounting of the actuating members is inconvenient and it may require repeatedly upsetting the frame.

European patent application no. 05425179 by the same Applicant (not yet published as of the filing date of the present application) describes a drive assembly for door and window frames provided with actuating members with a single tenon which are inserted in transverse direction into the respective longitudinal slots of the frame. Said document does not describe that the actuating members all engage a same undercut engagement area of the respective groove.

The document DE-A-3225049 describes a door or window frame in which the longitudinal groove comprises a single undercut engagement area and with a lateral wall of the groove with a T shape engaged at opposite sides by two opposite tenons of the actuating members.

SUMMARY OF THE INVENTION

The object of the present invention is to provide actuating members for door and window frames that can be mounted with greater simplicity relative to prior art solutions.

According to the present invention, said object is achieved by a door or window. that includes a movable quadrangular frame formed by four section bars each having a longitudinal groove. Each of the longitudinal grooves comprising a base, two parallel lateral walls and two edges oriented towards each other, wherein the edges and the lateral walls define a first undercut engagement area adjacent to a first face of the frame and a second undercut engagement area adjacent to a second face of the frame. The door or window further includes a drive assembly for opening/closing the movable quadrangular frame. The drive assembly comprising a plurality of actuating members and a plurality of transmission rods that operatively connect adjacent actuating members to each other, wherein each of the actuating members and each of the transmission rods has a single integral tenon, and wherein the tenons of all the actuating members and the tenons of all the transmission rods engage the first undercut engagement area.

In the solution according to the present invention, the actuating members have a single tenon and they all engage the undercut engagement area situated on the same side of the respective groove.

Thanks to this solution idea, during the assembly of the actuating members in the grooves of the section bars, it is not necessary repeatedly to upset the frame to mount the actuating members in alternated fashion.

BRIEF DESCRIPTION OF THE DRAWINGS

The present invention shall now be described in detail with reference to the accompanying drawings, provided purely by way of non limiting example, in which.

DETAILED DESCRIPTION

Figure 1:
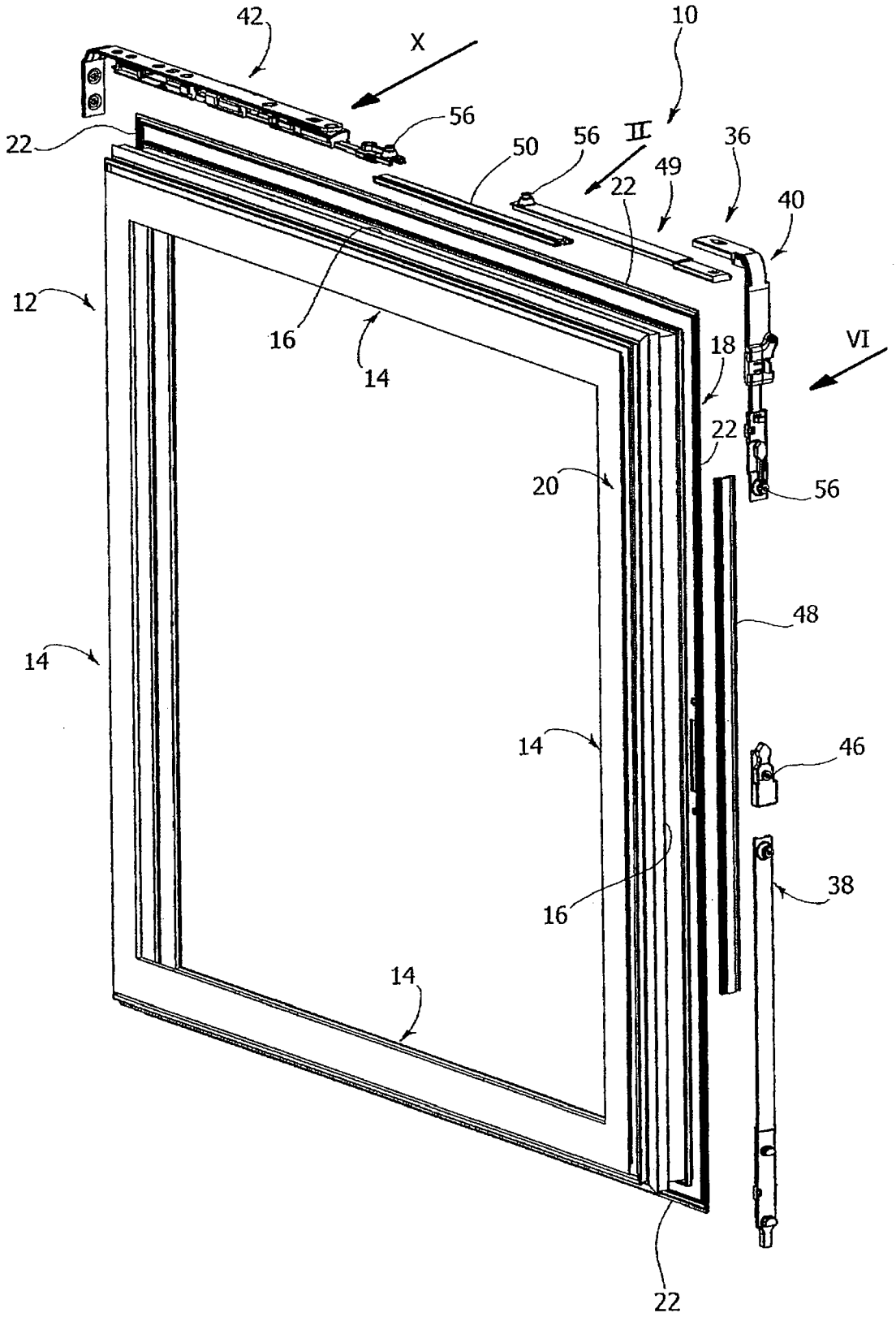
FIG. 1 is a perspective view of a window or door frame according to the present invention.

With reference to FIG. 1, the number 10 designates a door or window frame according to the present invention. The door or window frame 10 comprises a quadrangular frame 12 formed by four section bars 14 preferably constituted of aluminium or alloys thereof. Each of the section bars 14 has an outer side provided with a longitudinal groove 16.

Figure 2:
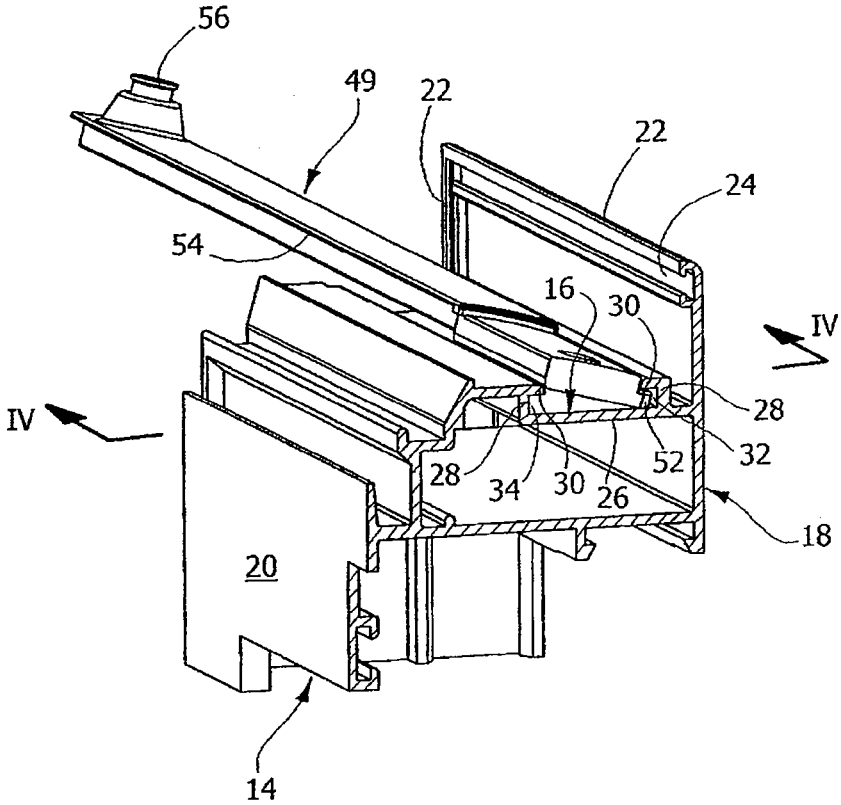
FIG. 2 is a partially sectioned perspective view showing the mounting sequence of an actuating member indicated by the arrow II in FIG. 1.
Figure 3:
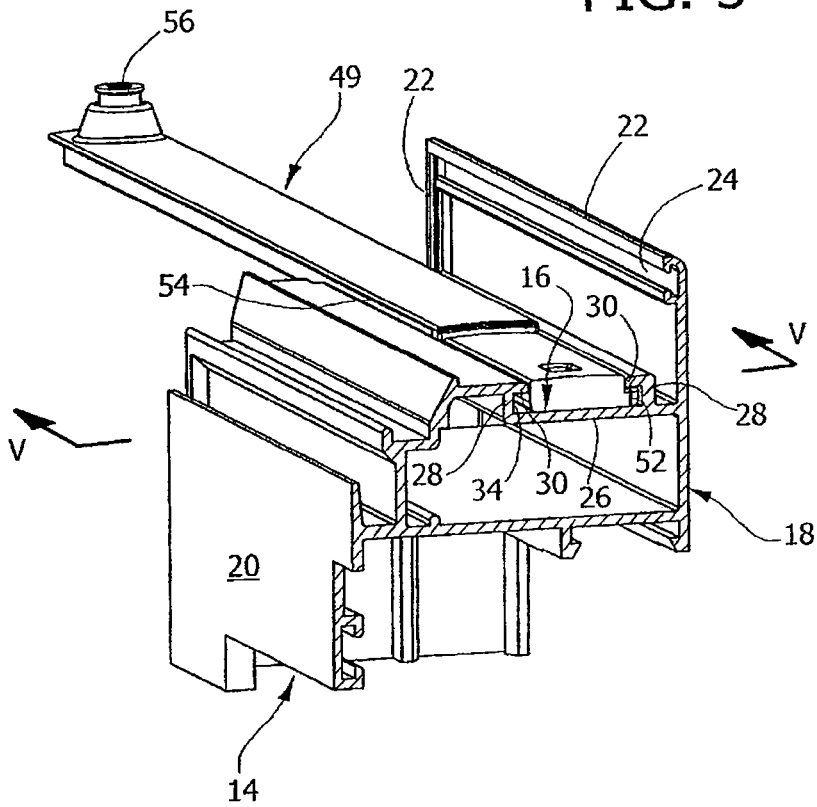
FIG. 3 is also a partially sectioned perspective view showing the mounting sequence of an actuating member indicated by the arrow II in FIG. 1, FIGS. 4 and 5 are sections respectively according to the lines IV-IV and V-V of FIGS. 2 and 3.

With reference to FIGS. 2 and 3, the frame 12 has two front faces designated respectively by the numbers 18 and 20. The section bars 14 have respective front bearing edges 22 aligned to the first face 18 of the frame 12 and projecting outwards beyond the respective groove 16. The front bearing edges 22 have respective grooves 24 able to receive a front sealing gasket (not shown) which in the closed position of the window or door frame is pressed against a front surface of the fixed frame of the door or window.

Figure 4:
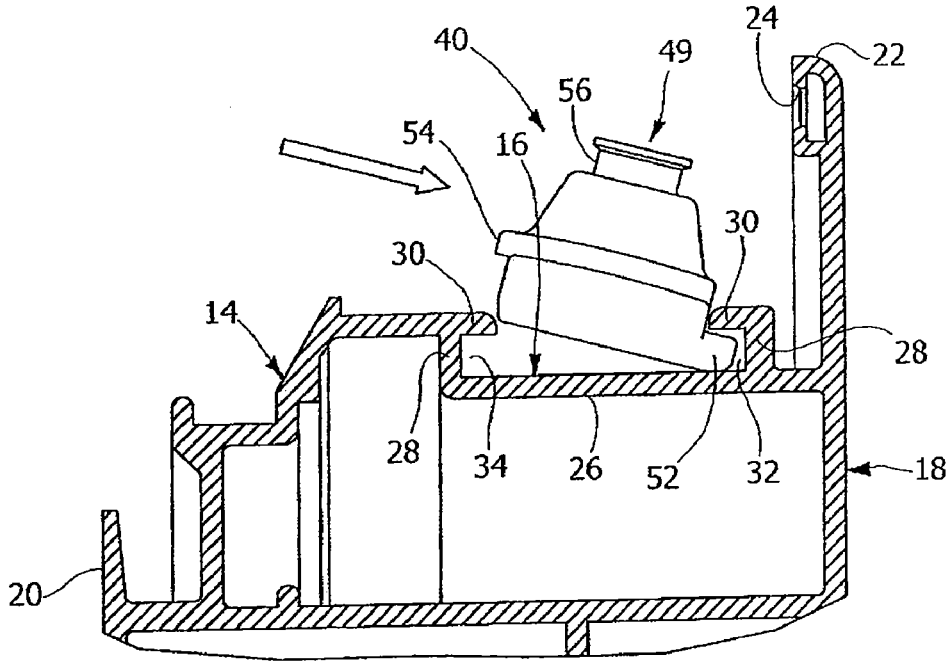

With reference for example to FIGS. 2 and 4, the longitudinal groove 16 of each section bar 14 comprises a base 26, two lateral walls 28 and two longitudinal edges 30 oriented towards each other. The two longitudinal ends of the edges 30 facing each other define the outer opening of the longitudinal groove 16. The longitudinal edges 30 define an undercut engagement area at each lateral wall 28 of the groove 16. A first undercut engagement area 32 is adjacent to the first face 18 of the frame 12 and a second undercut engagement area 34 is adjacent to the second face 20 of the frame 12.

Each undercut engagement area 32, 34 has substantially "C" shape and is defined between the inner surfaces of the edge 30, of the lateral wall 28 and by the lateral portion of the base 26. The shape of the longitudinal groove 16 is standardised and it is used by most metallic section bars for door or window frames.

With reference to FIG. 1, the window or door frame 10 is provided with a drive assembly globally designated by the number 36. The drive assembly 36 comprises a plurality of actuating members 38, 40, 42, 46 49 and a plurality of transmission rods 48, 50 that operatively connect adjacent actuating members to each other. The drive assembly 36 shown in FIG. 1 is that of a door or window frame with wing and swivel opening and it comprises a vertical fulcrum 38, an angled transmission 40, a scissors arm 42 a cremone bolt coupling and a cursor 49.

According to the present invention, each actuating member and each transmission rod is provided with a single integral tenon for engagement with the respective groove 16, so that all the components of the drive assembly 36 can be mounted frontally in the respective grooves. The tenons of the actuating members and of the transmission rods all engage the undercut engagement area 32 of the respective groove 16 adjacent to the first wall 18 of the frame 12, i.e. the wall provided with front bearing edge 22.

FIGS. 2 to 11 schematically show some details and the manners of mounting of some actuating members 40, 42, 49 comprising the drive assembly 36.

Figure 5:
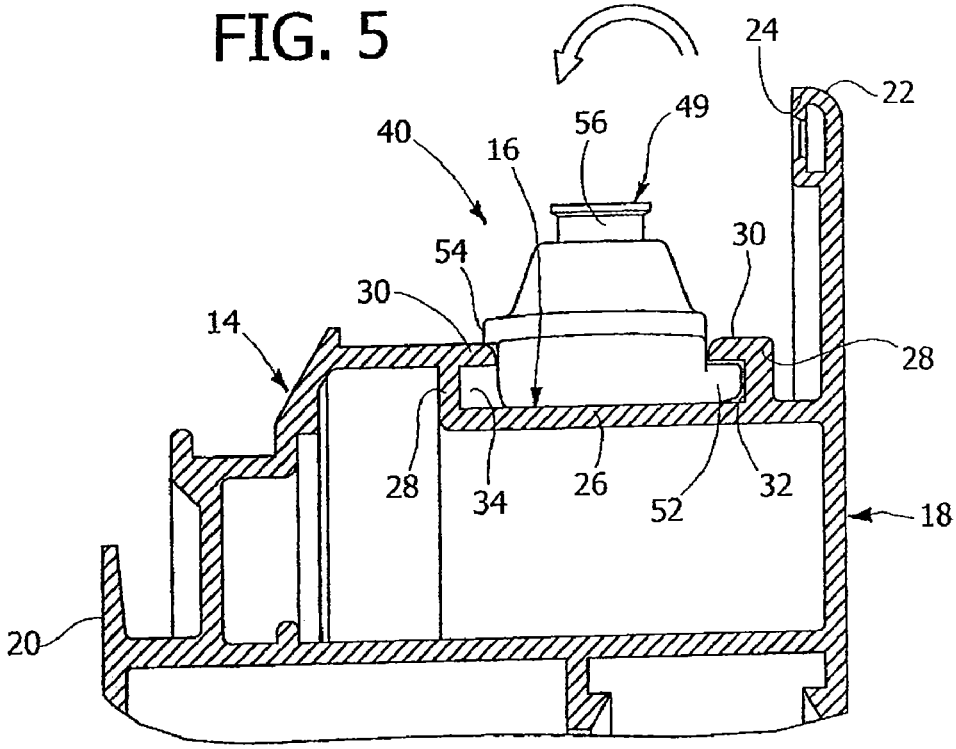

With reference to FIGS. 2 through 5, the actuating member 49 (cursor) has a single tenon 52 obtained in integral form with the body of the actuating member 49 and engaging the first undercut engagement area 32 of the groove 16. The actuating member 49 is mounted by positioning the tenon 52 into the first undercut engagement area 32 as shown in FIGS. 2 and 4 and then making the engagement member 49 oscillate towards the interior of the groove 16 obtaining the frontal insertion of the actuating member 49 into the groove 16 as shown in FIGS. 3 and 5. On the opposite side of the tenon 52, the actuating member 49 is provided with a bearing longitudinal edge 54 that bears on the outer side of the edge 30 situated at the second undercut engagement area 34.

The actuating member 49 is fastened to the transmission rod 50 by means of a screw 56. The manner in which each actuating member 38, 40, 42, 46 and 49 is fastened to the respective transmission rods 48, 50 is described in detail in a contemporaneous patent application by the same Applicant.

Figure 6:
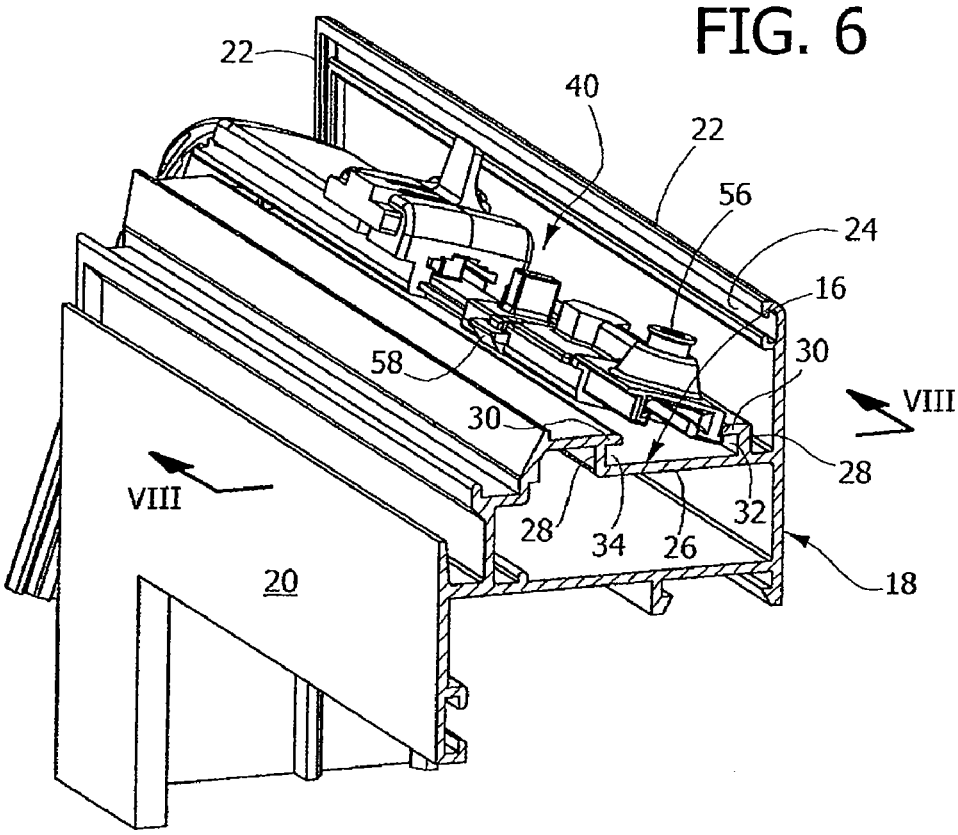
FIG. 6 is a partially sectioned perspective view showing the mounting sequence of the actuating member indicated by the arrow VI in FIG. 1.
Figure 7:
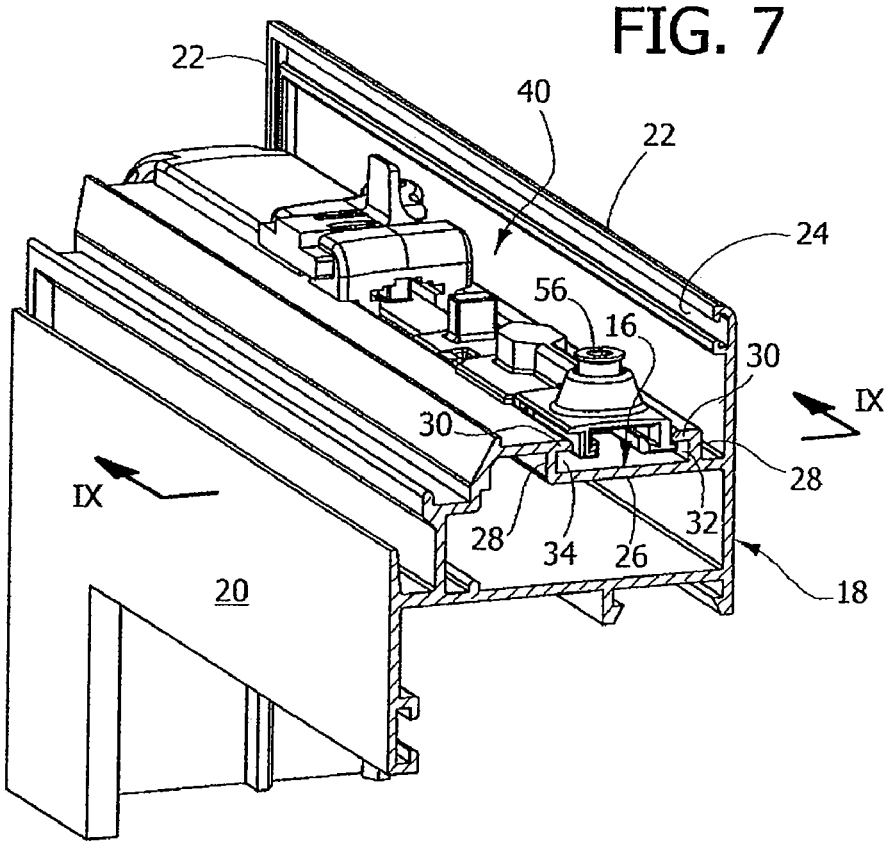
FIG. 7 is also a partially sectioned perspective view showing the mounting sequence of the actuating member indicated by the arrow VI in FIG. 1, FIGS. 8 and 9 are sections respectively according to the lines VIII-VIII and IX-IX of FIGS. 6 and 7.
Figure 8:
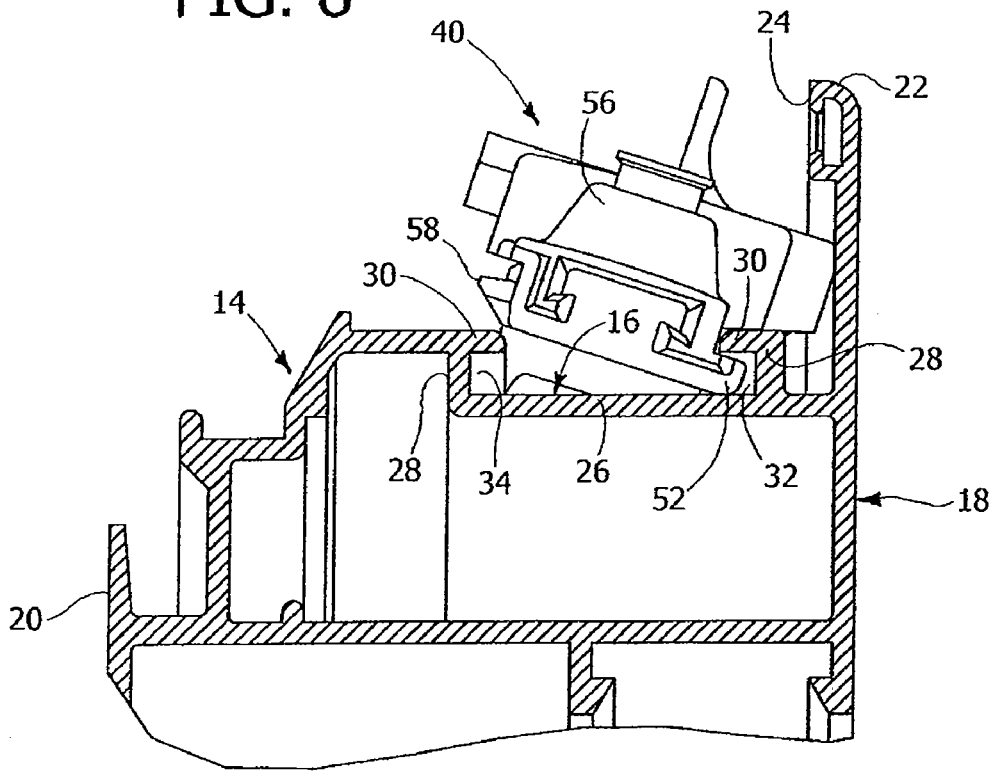
Figure 9:
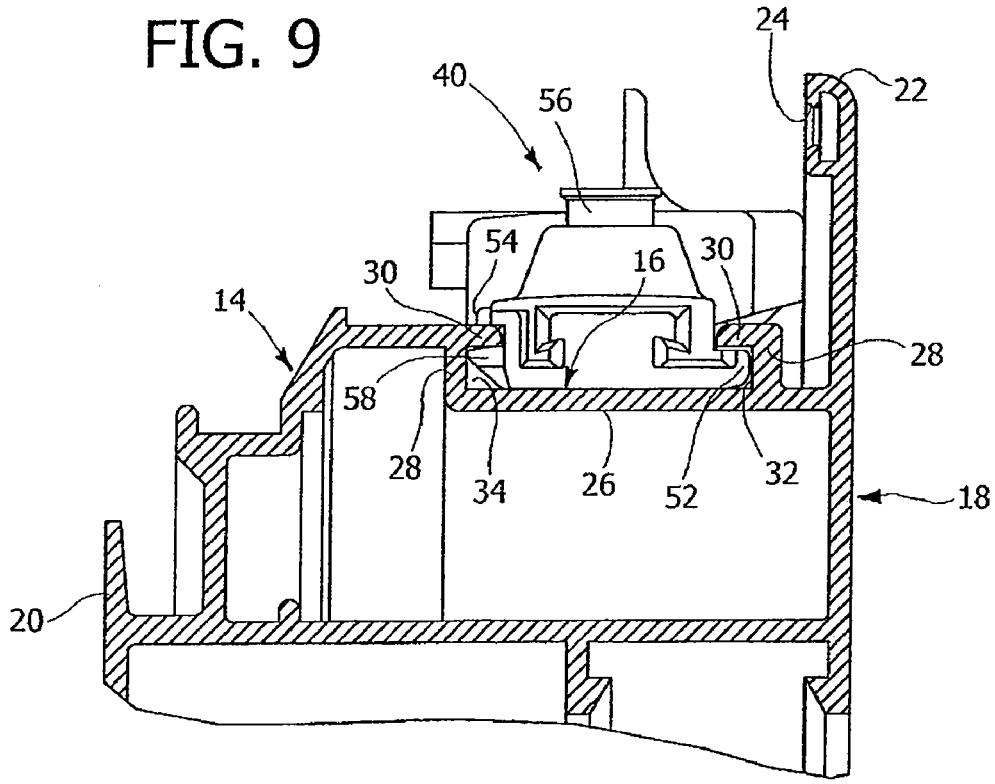

FIGS. 6 through 9 show the way in which the frontal mounting of the angled transmission 40 is carried out. In this case, too, the angled transmission 40 is provided with a single integral tenon 52 that engages the first undercut engagement area 32 of the longitudinal groove 16. The mounting operation is carried out by frontally inserting the angled transmission 40 into the groove 16 as indicated in FIGS. 6 and 8 and then making the angled transmission 40 oscillate towards the interior of the groove 16 until it reaches the position shown in FIGS. 7 and 9. On the opposite side of the tenon 52 there is a bearing edge 54 that bears on the outer side of the edge 30 situated at the second undercut engagement area 34. The angled transmission 40 can also be provided with a recessing tooth 58 that engages in snap-in fashion the edge 30 during the frontal insertion into the groove 16. The recessing tooth 58 is thrust elastically outwards and it has the purpose of holding the angled transmission 40 inside the groove 16 during the assembly. Similar retaining teeth can also be provided on other actuating members of the assembly 36.

Figure 10:
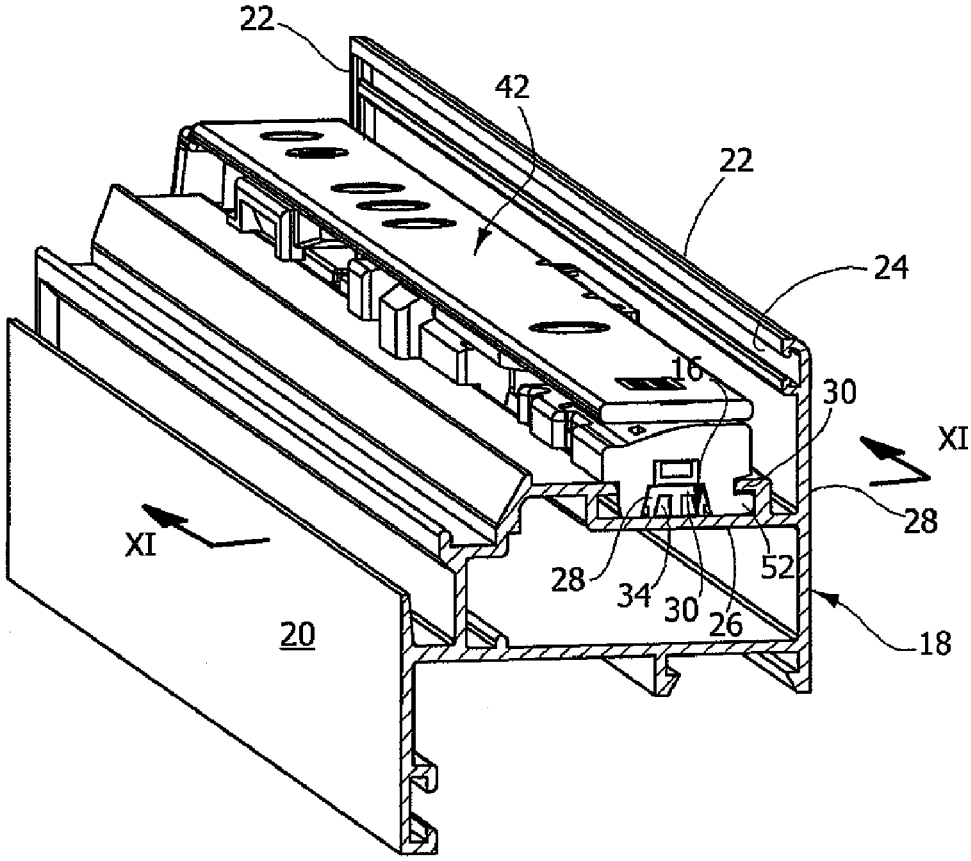
FIG. 10 is a partially sectioned perspective view showing the actuating member indicated by the arrow X in FIG. 1 in the mounted position.
Figure 11:
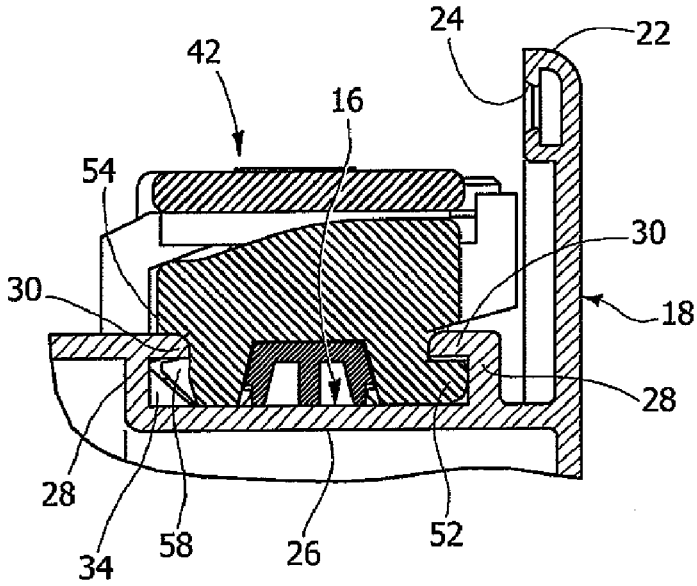
FIG. 11 is a section according to line XI-XI of FIG. 10.

With reference to FIGS. 10 and 11, the scissors arm 42 is also mounted in the manner described previously. FIGS. 10 and 11 show the scissors arm 42 at the end of the mounting in the groove 16. The insertion takes place frontally, positioning the single integral tenon 52 in engagement with the first undercut engagement portion 32 and then making the scissors arm 42 oscillate towards the interior of the groove 16.

The fact that all the actuating members and all the transmission rods are provided with a single tenon for connection to the section bars 14 could cause instability problems due to pressures on the door or window frame. However, said problems are solved thanks to the fact that all the actuating members engage the undercut engagement area 32 of the groove 16 that is oriented towards the face 18 of the frame 12 provided with the front bearing edge 22. In the case of inward opening door and window frames, the face 18 is the inner face of the door or window frame whilst in the case of outward opening door and window frames, the face 18 is the outer face of the door or window frame.

The fact that all the tenons of the drive assembly 36 engage the inner portion of the groove 16 in the case of inward opening door and window frames and the outer portion of the groove 16 in the case of outward opening door and window frames determines a complete stability, even without a tenon with structural function on the opposite side of the groove 16. It can be demonstrated that the connection between the actuating members and the section bars 14 is perfectly stable in the case of thrusts directed from the outside inwards, in the case of inwardly opening door and window frames, or under the action of thrusts directed from the inside outwards, in the case of outwardly opening door and window frames.

The fact that all the tenons of the drive assembly 36 engage the same side of the groove 16 enables to carry out the frontal mounting of the actuating members and of the transmission rods without upsetting the frame 12, i.e. keeping the frame 12 with the face 18 bearing on a horizontal plane during the entire assembly operation.

While the foregoing is directed to embodiments of the present invention, other and further embodiments of the invention may be devised without departing from the basic scope thereof.

The invention claimed is:

1. A closure, comprising:

a movable quadrangular frame formed by four section bars each having a generally U-shaped longitudinal groove, said frame being selectively pivotable about one of a generally horizontal axis and a generally vertical axis, each of said longitudinal grooves comprising: a base, two parallel lateral walls and two ledges extending from distal ends of said walls towards each other, said ledges and said lateral walls defining a first undercut engagement area adjacent to a first face of the frame and a second undercut engagement area adjacent to a second face of the frame, and a drive assembly for controlling which of said axes the movable quadrangular frame will pivot about, said drive assembly comprising a plurality of movable actuating members and a plurality of movable transmission rods that operatively connect adjacent ones of said actuating members to each other, wherein each of said actuating members and each of said transmission rods has only one tenon, each of said tenons forming a one piece unitary element with a respective one of said transmission rods and said actuating members and wherein the tenons of all the actuating members and the tenons of all the transmission rods are disposed in said first undercut engagement area, and wherein all the actuating members and all the transmission rods each have a longitudinal projection opposite to a respective one of said tenons that bears on an outer side surface of a respective one of said ledges defining said second undercut engagement area, wherein each of said projections forming a one piece unitary element with a respective one of said transmission rods and said actuating members.

2. The closure as claimed in claim 1, wherein the window or door is an inwardly opening closure and said first face of the movable quadrangular frame is an inner face of the movable quadrangular frame.

3. The closure as claimed in claim 1, wherein the window or door is an outwardly opening closure and said first face of the movable quadrangular frame is an outer face of the movable quadrangular frame.

4. The closure as claimed in claim 1, wherein at least one of said actuating members comprises at least one snap-in engagement tooth elastically engaging a corresponding one of said ledges.

* * * * *

UNITED STATES PATENT AND TRADEMARK OFFICE

CERTIFICATE OF CORRECTION

PATENT NO. : 7,644,538 B2
APPLICATION NO. : 11/761298
DATED : January 12, 2010
INVENTOR(S) : Balbo Di Vinadio It is certified that error appears in the above-identified patent and that said Letters Patent is hereby corrected as shown below:

In the Claims:

Column 6, Claim 2, Lines 24-25, please delete "window or door" and insert --closure-- therefor;

Column 6, Claim 3, Lines 28-29, please delete "window or door" and insert --closure-- therefor.

Signed and Sealed this

Sixteenth Day of March, 2010

David J. Kappos

David J. Kappos
*Director of the United States Patent and Trademark Office*